US006029619A

United States Patent [19]

Mitchell

[11] Patent Number: 6,029,619

[45] Date of Patent: Feb. 29, 2000

[54] REMOTE PRIMER

[75] Inventor: Robert K. Mitchell, Brookfield, Wis.

[73] Assignee: Briggs & Stratton Corporation, Wauwatosa, Wis.

[21] Appl. No.: 09/018,355

[22] Filed: Feb. 4, 1998

[51] Int. Cl.[7] ..... F02M 1/16

[52] U.S. Cl. ..... 123/179.11; 123/179.12; 261/DIG. 8

[58] Field of Search ..... 123/179.11, 179.9, 123/179.12, 179.13; 261/DIG. 8

[56] References Cited

U.S. PATENT DOCUMENTS

| | | | |
|---|---|---|---|
| 1,166,084 | 12/1915 | Ryder . | |
| 1,264,954 | 5/1918 | Maltby . | |
| 2,731,250 | 1/1956 | Yon | 261/18 |
| 3,281,129 | 10/1966 | Payne | 261/34 |
| 3,307,836 | 3/1967 | Arndt et al. | 261/34 |
| 3,345,045 | 10/1967 | Tuggle | 261/34 |
| 3,430,933 | 3/1969 | Taggart | 261/34 |
| 3,494,343 | 2/1970 | Nutten | 123/187.5 |
| 3,805,758 | 4/1974 | May | 123/139 AJ |
| 3,948,589 | 4/1976 | DuBois | 417/487 |
| 4,404,933 | 9/1983 | Kuczenski | 123/187.5 R |
| 4,589,386 | 5/1986 | Everts | 123/187.5 R |
| 4,738,232 | 4/1988 | Scott | 123/179.11 |
| 4,793,206 | 12/1988 | Suzuki | 74/501.5 R |
| 4,803,963 | 2/1989 | Kleinhans | 123/179.12 |
| 5,023,417 | 6/1991 | Magiera | 200/331 |
| 5,750,056 | 5/1998 | Pitman et al. | 123/179.11 |

FOREIGN PATENT DOCUMENTS

| | | | |
|---|---|---|---|
| 1-200051 | 8/1989 | Japan | F02M 1/16 |

OTHER PUBLICATIONS

S–1249 Murray Corporation, Walk Behind Mower Improvement, Feb. 7, 1997, pp. 1–6.

*Primary Examiner*—Andrew M. Dolinar
*Attorney, Agent, or Firm*—Michael Best & Friedrich LLP

[57] ABSTRACT

A remote priming device that is particularly adaptable to a working machine having a handle section and an internal combustion engine with a resilient primer bulb, may be designed as a kit and retrofitted onto the working machine. The remote priming device includes a housing attachable adjacent the primer bulb, and a linearly movable member constrained to move within the housing such that the primer bulb is depressed in response to movement of the movable member. The resilient primer bulb has a vent hole and the movable member includes a bulb depressing surface. The remote priming device also includes an actuation device with a first end positioned adjacent the handle section and a second end positioned adjacent the housing. When a manually actuable member of the actuation device is actuated, the bulb depressing surface of the movable member covers the vent hole and the movable member moves linearly within the housing to depress the primer bulb. At least one spring interconnected between the housing and the actuation device enables the movable member to return to an unactuated state when the actuation device is disengaged. The actuation device can also be interconnected with a throttle arm for the engine throttle such that the actuation device can be actuated to effect motion of either the throttle arm or the movable member, or both.

32 Claims, 5 Drawing Sheets

REMOTE PRIMER

FIELD OF THE INVENTION

The present invention relates generally to the field of internal combustion engines. In particular, the present invention relates to internal combustion engines that utilize priming devices to aid in engine starting.

BACKGROUND OF THE INVENTION

Internal combustion engines are used in a variety of applications, such as for lawn mowers and snow blowers. Such engines often have carburetors wherein fuel received from a fuel source is mixed with air and supplied to a combustion chamber for ignition.

To aid in starting such engines it is desirable to introduce a small amount of fuel directly into the carburetor or fuel intake system. This may be accomplished through the use of a priming device, many of which have been marketed or illustrated in the patent literature. One such type of priming device includes a primer bulb that when depressed, displaces a volume of air into a carburetor float bowl or fuel well wherein the pressurized air pushes fuel from the carburetor into the engine intake system.

Bulb priming devices are typically located on the engine housing. The operator of a device such as a lawn mower or snow blower, standing upright behind the handle, is required to crouch down near the engine to prime the engine. Therefore, it would be desirable if the operator could prime the engine remotely from his upright position.

Bulb priming devices for internal combustion engines are well known in the prior art. U.S. Pat. No. 3,345,045 to Tuggle discloses a primer for an internal combustion engine, that uses a primer bulb, located on the engine, to pressurize air whereby fuel is injected into a fuel intake system. A primer bulb of this type could be located remotely from the engine but requires running air tubes from the bulb to the engine. Such tubes can easily be damaged if located on or near a handle section. Further, a remote primer of this sort requires a larger bulb than one located near the engine. The larger bulb is necessitated by substantial pressure losses that are increased with greater tubal lengths.

To provide convenience, remote switching devices have been designed for use on a variety of devices. For instance, a remote switching mechanism is disclosed in U.S. Pat. No. 5,023,417 to Magiera. This mechanism uses a bowden cable with a manually actuable member on a first end and a ball or spring on a second end that engages an electrical rocker switch. The '417 device does not disclose a remote switch that automatically returns to its unactuated state after it has been actuated, which is desirable when using the remote device to depress a primer bulb.

SUMMARY OF THE INVENTION

The invention is a remote priming device that solves the problems of the prior art. More particularly, the invention provides a simple device with a remotely actuable member that, when actuated, causes depression of a primer bulb located on or near the engine. Further, the invention may be designed as a kit if it is not integrated with the throttle control, retrofittable onto an existing engine with a primer bulb.

One aspect of the invention is a working machine, such as a lawn mower or snow blower, that has a handle section, an internal combustion engine with a resilient primer bulb, and a priming device that includes a housing, a linearly movable member or block, and a remote actuation device.

In one embodiment of the invention, the primer bulb has a vent hole that is covered by the movable block when the priming device is engaged to depress the primer bulb.

In another embodiment of the invention, a sliding bent rod is constrained to slide within the housing when actuated. The bent rod engages and depresses the movable block which in turn depresses the primer bulb.

In another embodiment of the invention, the housing contains a cam that is rotatable about a pin, the pin being fixed to the housing. When actuated, the cam rotates about the pin, engages, and depresses the linearly movable block.

In another embodiment of the invention, the movable block has a groove that guides the block's motion, and the housing has a protrusion that fits in the groove. When actuated, the protrusion rides in the groove and the block depresses the primer bulb.

In another embodiment of the invention a return spring is located in the housing. The spring enables the movable block to return to an unactuated state.

The invention may also include a return spring located within the support for the manually actuable member. The spring returns the manually actuable member to an unactuated state.

A return spring may be located in the housing. The spring returns the movable block to an unactuated state. A return spring may also be located within the support for the manually actuable member. The spring returns the manually actuable member to an unactuated state.

In another aspect of the invention, a remote control device is provided to effect motion of a throttle arm interconnected with the engine throttle and also, to effect actuation of the primer. The remote control device may include a manually actuable member (e.g., a lever) supported on the handle section of the machine, an elongated member (e.g., a rod or bowden cable) interconnected with the actuable member, and an intermediate member (e.g., a rod or cable) interconnected with the elongated member. The elongated member is also interconnected with the throttle arm and the intermediate member is engageable with a linearly movable member (e.g., a movable block) to depress the primer bulb. In one embodiment, the elongated member and the intermediate member are movable together as one elongated assembly along a substantially curvilinear path to effect motion of the linearly movable member and to actuate the primer.

Preferably, the remote control device includes a lost-motion connection disposed between the elongated member and the intermediate member such that the elongated member may be moved to effect motion of the throttle arm without effecting motion of the movable member. Such a lost motion connection may include a chamber or housing on one of the elongated member and the intermediate member, and an enlarged end portion (e.g., a ball-shaped end portion) on the other one of the elongated member and the intermediate member. The enlarged end portion is constrained to move within the chamber. The actuation device may also include a second lost-motion connection that allows for actuation of the primer without effecting motion of the throttle arm. This second lost-motion connection may include a compressible spring interengaged between the throttle arm and the elongated chamber.

If the invention is not integrated with the throttle control, the invention may be sold as a kit that is retrofittable to an existing engine with a primer bulb. Such a kit includes a manually actuable member in a support that can be mounted on a handle section of a machine, a housing that can be mounted on an engine, a movable block for depressing a primer bulb, and a cable or rod that moves in response to actuation or movement of the actuable member to effect motion of the movable block.

An important feature and advantage of the invention is that it allows the operator of a machine to prime the engine without moving from an upright, use-oriented position.

Another feature and advantage of the invention is that it may be designed in a retrofittable kit form. This allows the invention to be sold as an option.

Another feature and advantage of the invention is that a housing surrounds the movable block, thereby keeping it substantially free of foreign matter that could impede its movement.

Another feature and advantage of the invention is that it may have a return spring so that the primer bulb is not kept depressed during operation of the engine.

Another feature and advantage of the invention is a mechanism that allows for priming and engine throttle control via a single hand operable remote control device.

Another feature and advantage of the invention is that the use of a movable block, in conjunction with a bowden cable and a bent rod or cam, allows the primer bulb to be located on the front or side of the engine. In the case of the bent rod, the bowden cable may enter the housing parallel to the plane in which the base of the primer bulb lies. In the case of the cam, the bowden cable may enter the housing parallel to the plane in which the base of the primer bulb lies.

Other features and advantages of the invention will become apparent to those skilled in the art upon review of the following detailed description, claims, and drawings.

DETAILED DESCRIPTION OF THE INVENTION

FIGS. 1 through 12 depict a number of embodiments of the present invention. Each of the illustrated embodiments of the invention is used with an internal combustion engine having an engine fuel primer.

Figure 1:
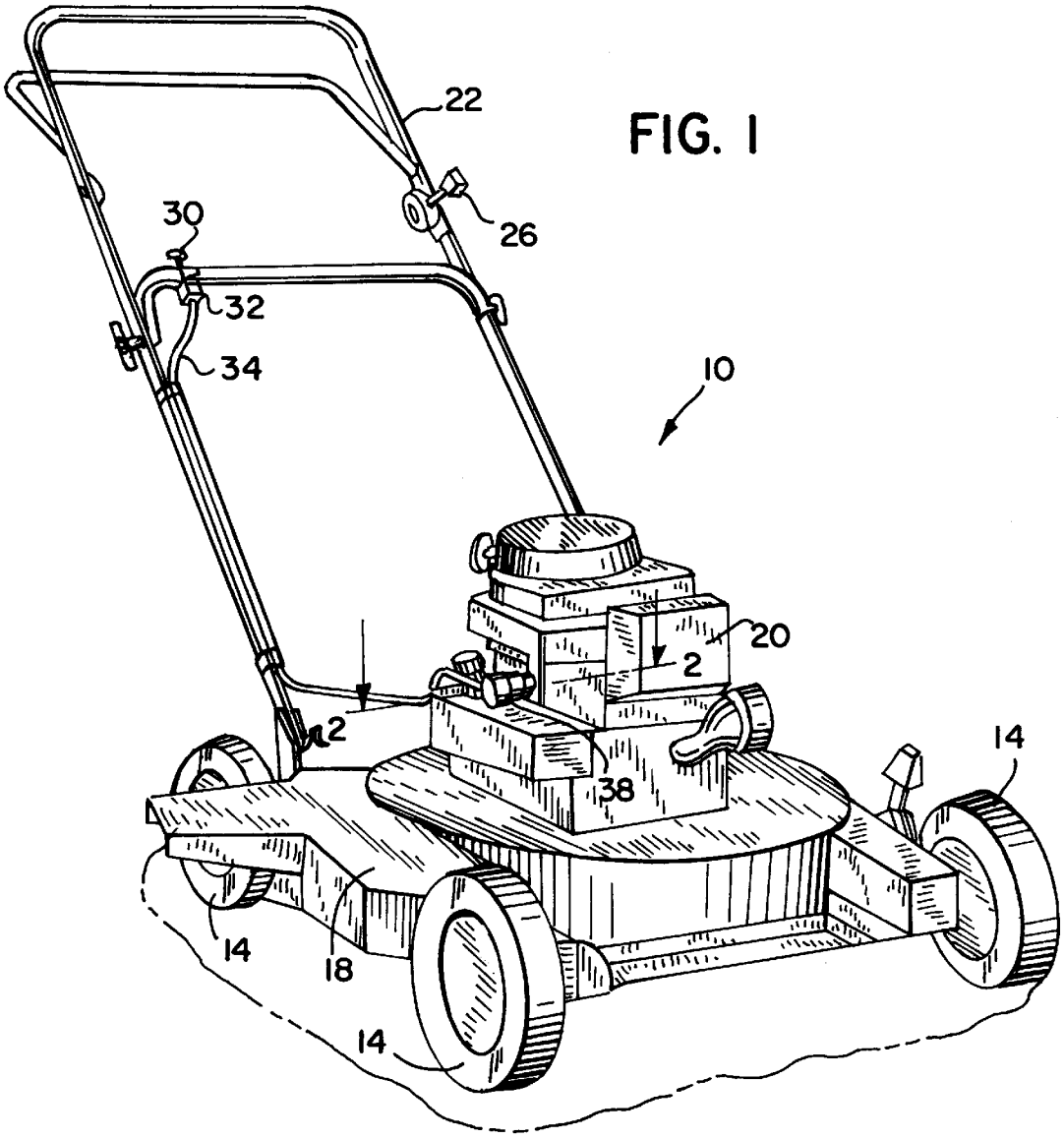
FIG. 1 is a perspective view of a lawn mower incorporating a first embodiment of the invention.

Depicted in FIG. 1 is a lawn mower 10 incorporating a first embodiment of the invention. Lawn mower 10 comprises a set of wheels 14, a deck 18, an engine 20, a handle 22, a throttle lever 26, a primer button 30, a support 32, a bowden cable 34, and a housing 38. Engine 20 is mounted on deck 18 and is an internal combustion engine having a resilient primer bulb 42, as shown in FIGS. 4, 5, 6, 7, 11, and 12, that is used to inject fuel directly into the mixing passage of the carburetor, or to increase the head pressure on fuel in the carburetor fuel bowl.

Figure 8:
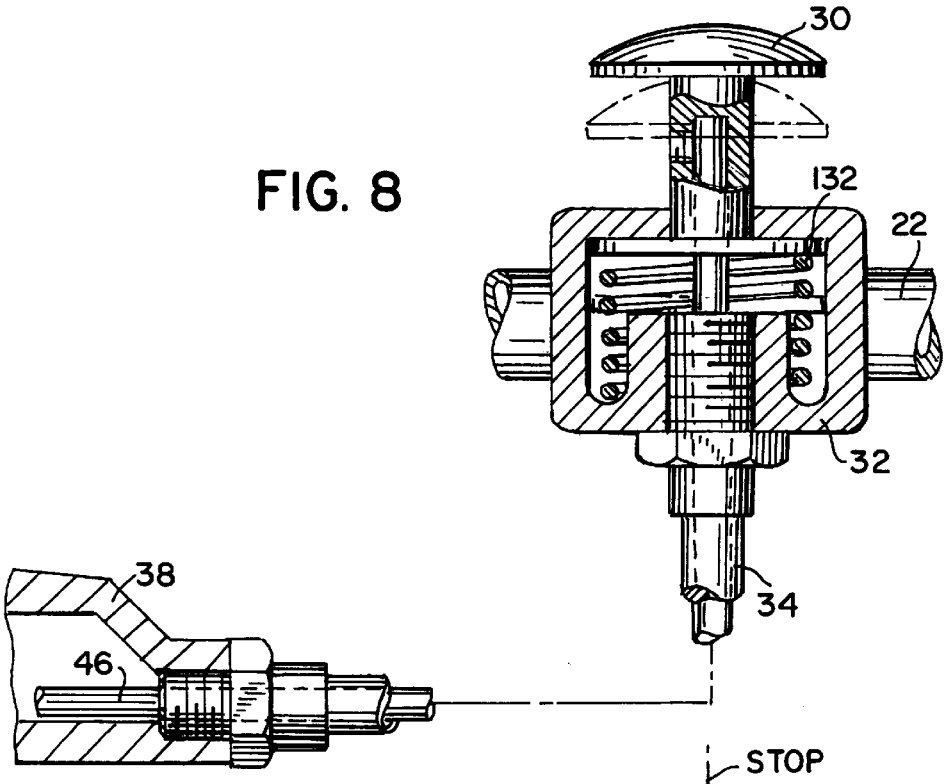
FIG. 8 is a cross-sectional side view of the actuation device shown in FIG. 1, depicting a manually operable button in a handle mounted support having a return spring and interconnected with the housing by a bowden cable.

Housing 38 is mounted on engine 20 covering, substantially surrounding, or adjacent to primer bulb 42. Handle 22 is mounted to deck 18 to allow a user to push lawn mower 10 and to provide a support for mounting throttle lever 26, support 32 and any other user controls. As shown in FIG. 8, support 32 guides primer button 30. When pushed, button 30 actuates the priming device by causing movement of bowden cable 34 and subsequently causing movement within housing 38 that depresses primer bulb 42.

Figure 4:
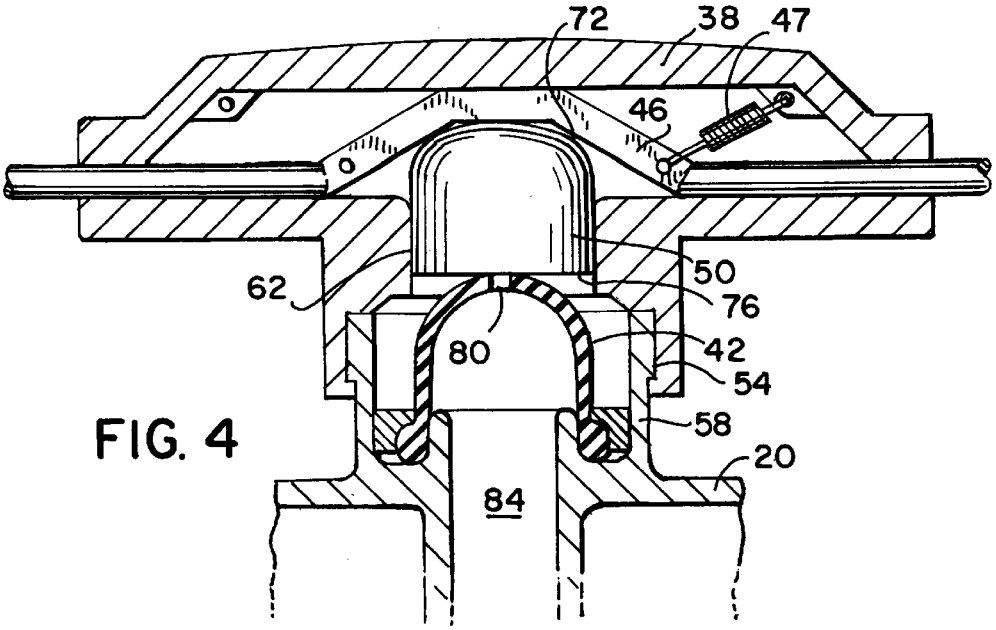
FIG. 4 is a cross-sectional side view of a primer housing depicting a linearly movable block, a bent rod disposed within said housing, and a resilient primer bulb, used in the first embodiment of the present invention.
Figure 5:
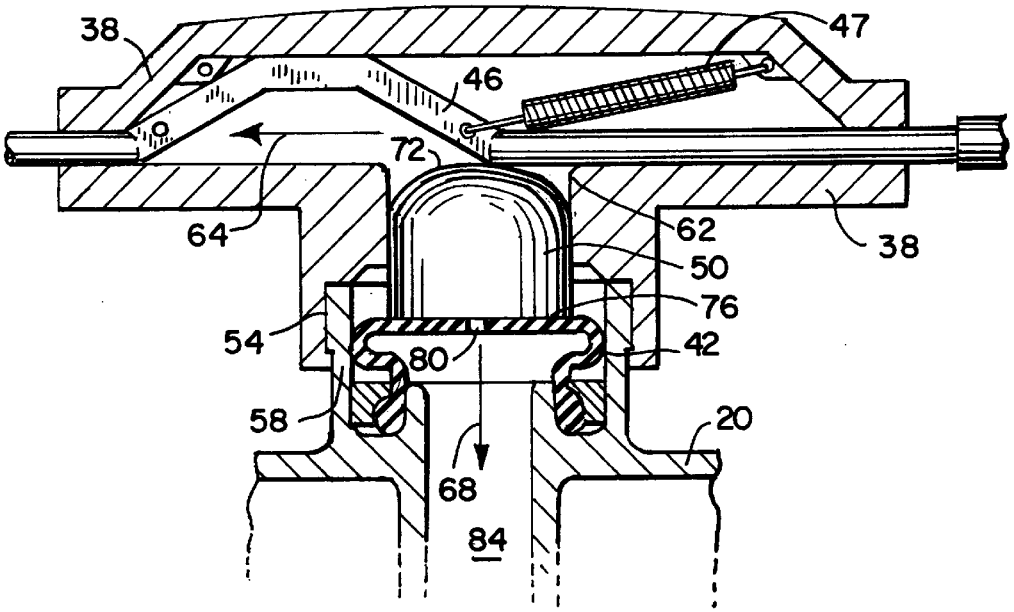
FIG. 5 is a cross-sectional side view, of the housing of the first embodiment, as shown in FIG. 4, showing the bent rod and the movable block in an actuated position depressing the primer bulb.

FIGS. 4 and 5 depict a first embodiment of the invention showing engine 20, housing 38, primer bulb 42, a slidable bent rod 46, and a linearly movable block 50. Although member 50 is shown and described herein as a movable block, other configurations of member 50 may be used. Housing 38 is mounted on engine 20 substantially surrounding primer bulb 42. Numerous methods exist to mount housing 38, including but not limited to flange surfaces 54 that engage flanges 58 of engine 20. Alternatively, bolts or screws, welded seams, adhesive seams, threaded surfaces, or mounting brackets could be used to mount housing 38 on engine 20.

In a first embodiment of the invention, shown in FIGS. 4 and 5, bent rod 46 is constrained to slide within housing 38. Movable block 50 is also constrained to move, substantially linearly, by a sleeve 62 of housing 38. Bent rod 46 responds to motion of bowden cable 34 by sliding within housing 38, in a direction of motion 64, substantially normal to a block direction of motion 68. When bowden cable 34 is actuated, rod 46 engages a rounded rod engagement surface 72 of block 50. The motion and shape of bent rod 46 causes block 50 to move in block direction of motion 68. Block 50 has a substantially flat bulb depressing surface 76 that covers vent hole 80 of primer bulb 42 when actuated. As bent rod 46 moves in rod direction 64, block 50 depresses bulb 42 as depicted in FIG. 5. Depression of bulb 42 causes pressurization of air passageway 84 which results in injection of fuel into the fuel intake of engine 20.

Some resilient primer bulbs 42 will have sufficient spring action to return movable block 50 to an unactuated position as depicted in FIG. 4. However, some resilient bulbs may not generate sufficient force to return block 50 to an unactuated state. If this is the case, a variety of spring configurations may be used to cause the return of movable block 50 to its rest state. These include the use of a spring 47 interconnected between housing 38 and bent rod 46, or providing movable block 50 with a site for engaging a return spring.

A variety of spring types may be used, including but not limited to coil springs, leaf springs, elastic bands, or resilient balls, bulbs, or columns.

Figure 6:
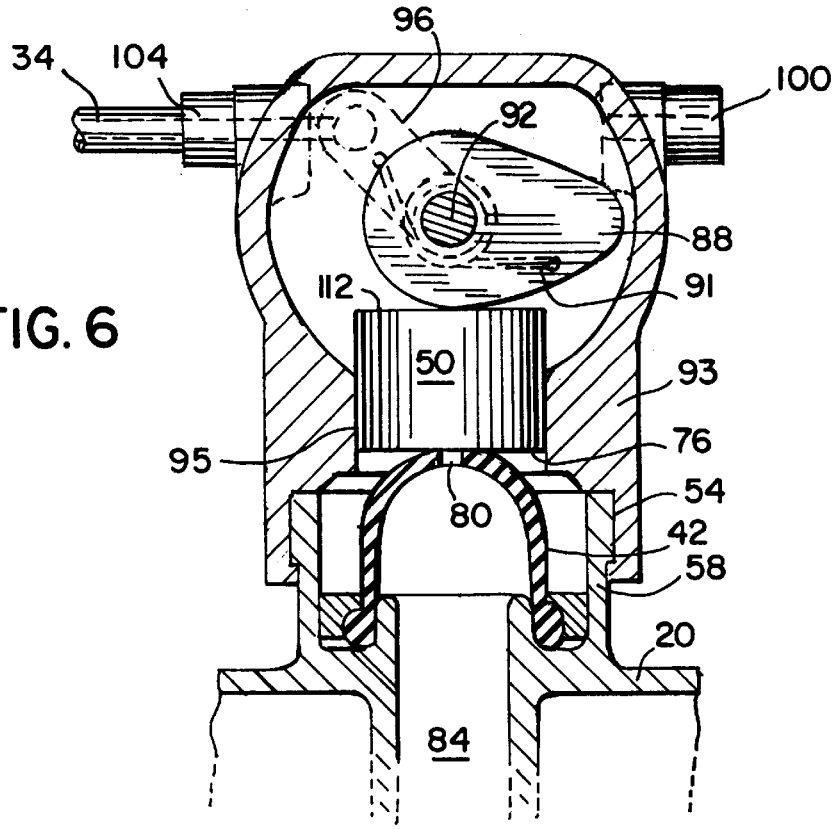
FIG. 6 is a cross-sectional side view of a second embodiment of the invention, showing, a moment arm, a cam rotatable about a pin, and a movable block, all disposed within a housing.
Figure 7:
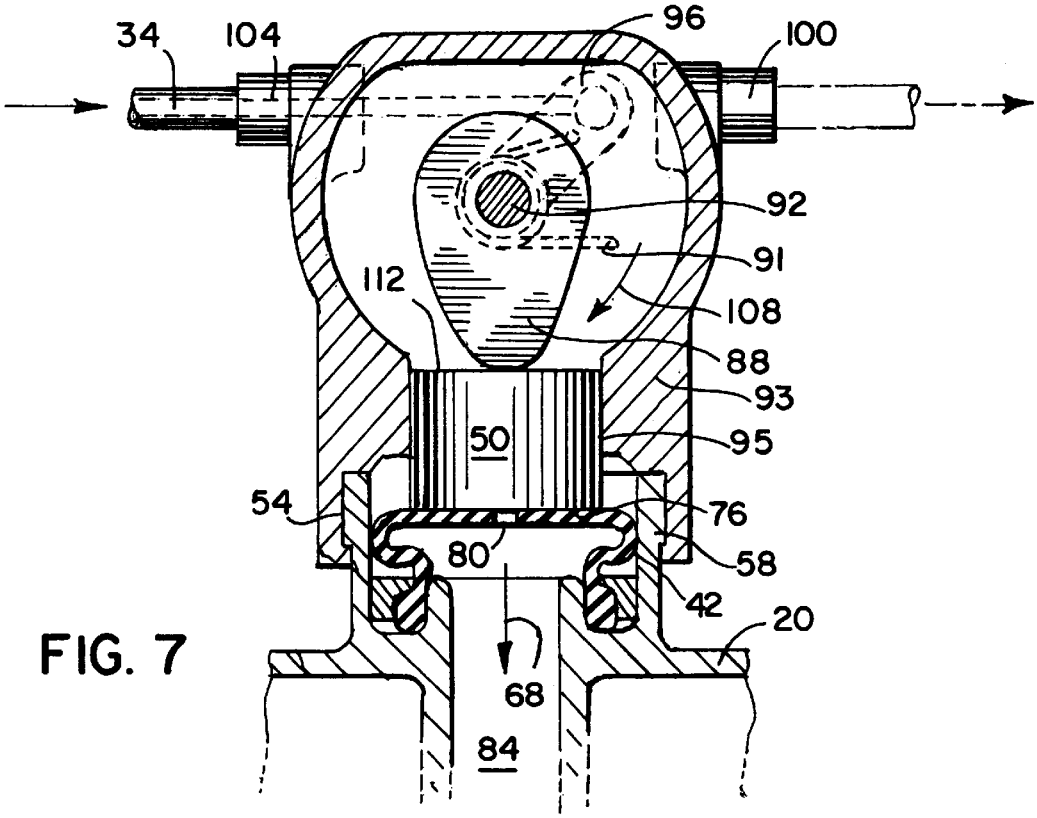
FIG. 7 is a cross-sectional side view of the housing of the second embodiment, depicting the cam and the movable block in an actuated position depressing the primer bulb.

A second embodiment of the invention is depicted in FIGS. 6 and 7 wherein a cam 88 is rotatably mounted on a pin 92. Pin 92 is substantially fixed to housing 93. A moment arm 96 interconnects bowden cable 34 and cam 88. Housing 93, as depicted in FIGS. 6 and 7, has an alternate cable aperture 100 that allows bowden cable 34 to enter through alternate aperture 100, instead of a primary cable aperture 104. Having alternate cable apertures is not necessary but allows for different configurations of the bowden cable on lawn mower 10.

FIG. 6 depicts the priming device in an unactuated state. FIG. 7 depicts the priming device in an actuated state. When bowden cable 34 is actuated it causes moment arm 96 to rotate. Cam 88 responds to the rotation of moment arm 96 by rotating in a cam direction 108. Cam 88 engages cam engagement surface 112 of block 50. The eccentric shape of cam 88 and the constraints of sleeve 95 of housing 93 cause movable block 50 to travel in block direction 68. Bulb depressing surface 76 covers vent hole 80 while bulb 42 is being depressed.

As in the first embodiment discussed above, a return spring may be provided that allows movable block 50 to return to its rest state. As shown in FIGS. 6 and 7, a return spring 91 may be interconnected between housing 93 and cam 88. Of course, other spring configurations may be used.

Figure 11:
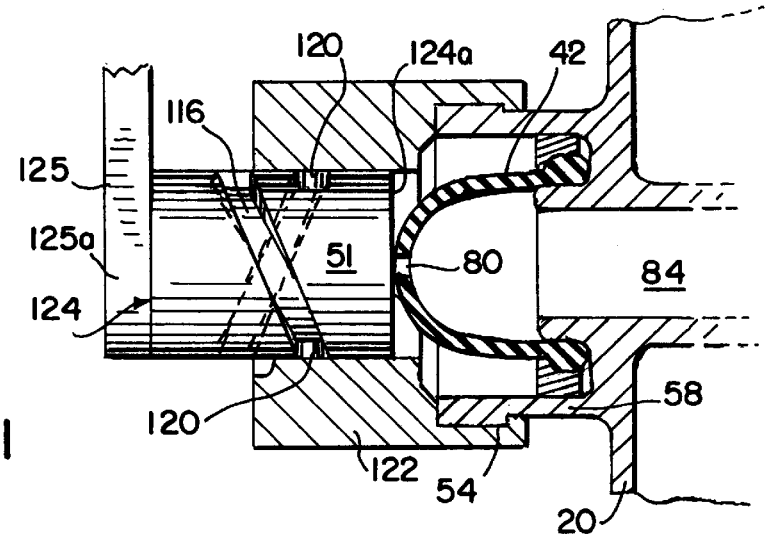
FIG. 11 is a cross-sectional side view of the housing of a third embodiment of the invention, showing a movable block with a groove riding on a protrusion within the housing.
Figure 12:
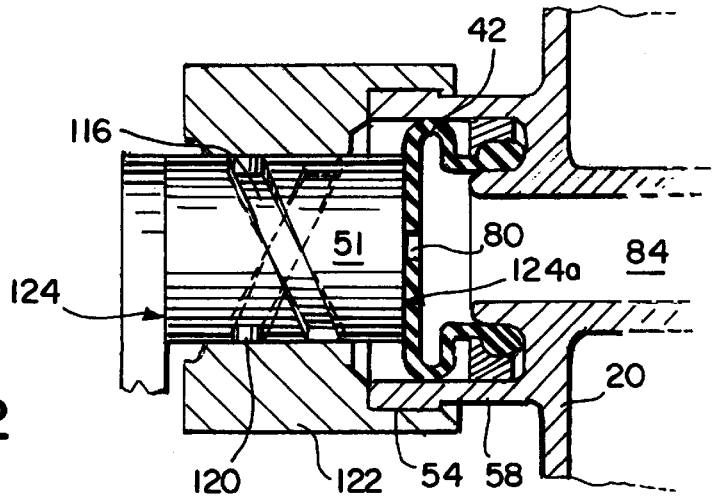
FIG. 12 is a cross-sectional side view of the third embodiment, as shown in FIG. 11, showing the movable block in the actuated position depressing the primer bulb.

A third embodiment of the invention is depicted in FIGS. 11 and 12. The remote priming device includes a movable block 51 that is substantially cylindrical and has a longitudinal axis, and a cylindrical housing 122. A resilient primer bulb 42 is disposed adjacent one end of housing 122. Movable block 51 is linearly and rotatably movable within housing 122 such that an end surface 124*a* of block 51 can engage and depress primer bulb 42.

The outer surface of movable block 51 is provided with a circumferential channel or groove 116 that is substantially inclined relative to the longitudinal axis. Groove 116 is engageable with a protrusion 120 located on the inner surface of housing 122. Movable block 51 also has a second end surface or actuator surface 124 that is substantially normal to the longitudinal axis. A base 125*a* of a lever arm 125 is attached to actuator surface 124. Lever arm extends outwardly from adjacent the actuator surface 124 to an opposite end (not shown), where the lever arm 125 is connected to a bowden cable (not shown).

FIG. 11 depicts the priming device in an unactuated state. FIG. 12 depicts the priming device in an actuated state. Lever arm 125 is connected to the bowden cable such that when the bowden cable is actuated, i.e., pulled or pushed, lever arm 125 rotates movable block 51 about the longitudinal axis. Because groove 116 engages protrusion 120, block 51 is constrained to rotate and move substantially axially, thereby depressing or releasing bulb 42.

FIG. 8 depicts one embodiment of an actuation device that can be used to cause motion of a block such as movable block 51 in FIGS. 11 and 12. FIG. 8 depicts the remote subassembly of the actuation device which includes support 32, substantially encasing a support spring 132, support 32 being mounted on handle 22, and supporting button 30, connected with bowden cable 34. Bowden cable 34 is partially depicted interconnecting button 30 and bent rod 46 in the housing.

Button 30 is one applicable type of manually actuable member that allows a user to cause movement of bowden cable 34. Alternatively, other actuation devices could replace button 30 including but not limited to, a lever, a push/pull rod, or a rotatable knob. Support spring 132, located substantially within support 32, is depicted as a coil spring. Although a coil spring is depicted in FIG. 8, alternatives include but are not limited to leaf springs, elastic bands, or resilient balls, bulbs, or columns. When button 30 is depressed and released, support spring 132 returns button 30 to its rest state or unactuated state. Also, when button 30 is depressed, movement is affected along bowden cable 34. Bent rod 46 responds to the motion of bowden cable 34 by extending into the housing and engaging movable block 50.

Figure 9:
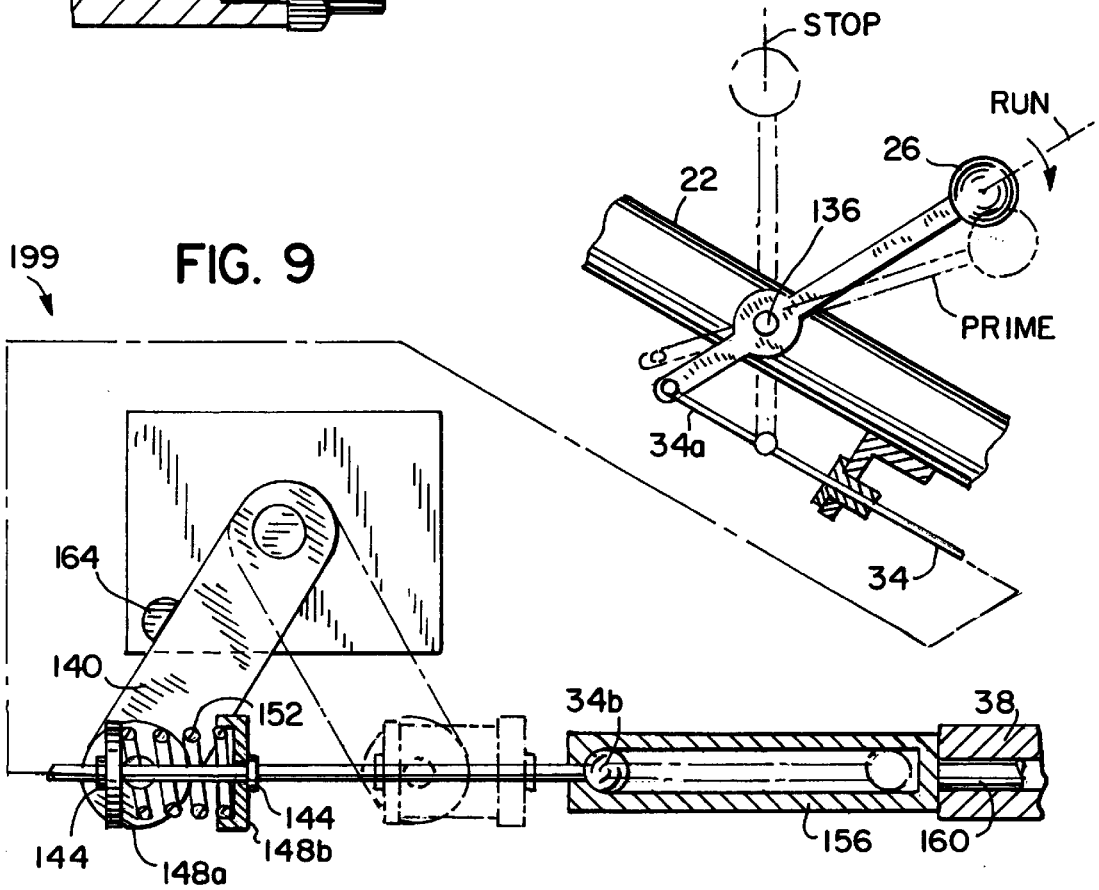
FIG. 9 is a partial cross-sectional side view of a remote control device that incorporates a remote priming device.
Figure 10:
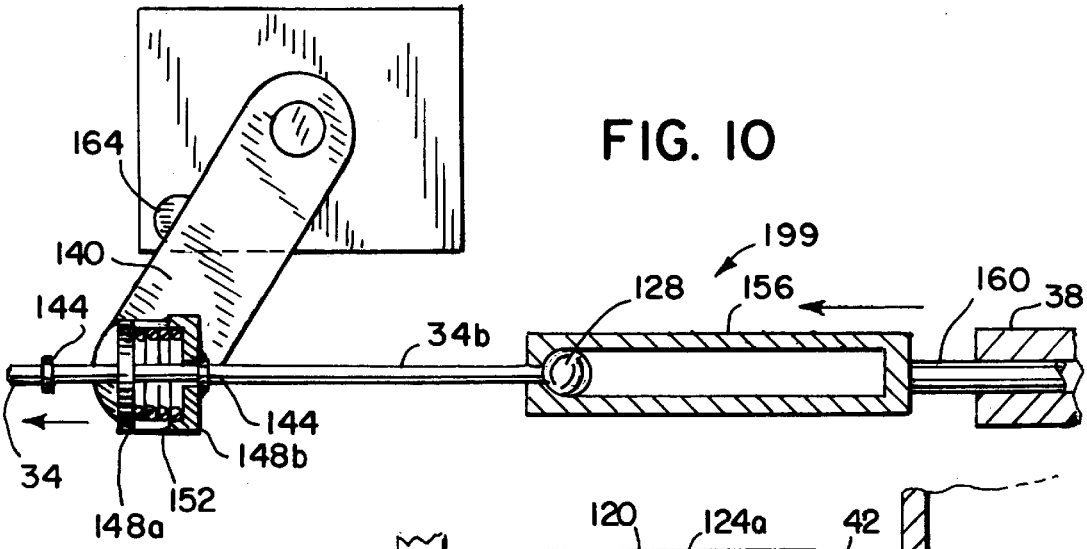
FIG. 10 is a partial cross-sectional side view of the remote control device shown in FIG. 9, depicting the primer in an actuated state.

FIGS. 9 and 10 depict a remote control device 199 embodying the invention. Remote control device 199 includes a control lever 26 that provides for manual control of the engine throttle (not shown), as well as remote priming of the engine. Control lever 26 is pivotally supported on a pin 136 that is substantially fixed to handle 22, and is rotatable about the longitudinal axis of pin 36 in either the clockwise or counter-clockwise direction.

Referring specifically to the view of FIG. 9, lever 26 may be rotated in the counter-clockwise direction to effect substantial closing of the throttle valve of the engine (not shown). In this operation, lever 26 is moved to a position that may be referred to as the STOP position, as shown in dash lines in FIG. 9. Control lever 26 may also be rotated in the clockwise direction to a PRIME position, thereby effecting actuation of the priming device. The PRIME position of lever 26 is also shown in dash lines in FIG. 9. In between the STOP and PRIME positions, lever 26 is rotatable to a RUN position wherein the throttle is substantially open. This RUN position of lever 26 is shown in solid lines in FIG. 9.

Lever 26 is connected to a first end 34*a* of cable 34 such that rotation of lever 26 effects linear movement of cable 34. An important feature of remote control device 199 is that the primer may be actuated by moving control lever 26 to the PRIME position, without effecting operation of the engine throttle. This feature is realized primarily through a lost-motion connection between cable 34 and a throttle arm 140 that is interconnected with the engine throttle. Another important feature is that the position of the engine throttle may be controlled by moving control lever 26 between the STOP and RUN positions, without effecting actuation of the primer. This feature of remote control device 199 is realized primarily through a lost-motion connection between cable 34 and a movable rod 160. Rod 160 is an intermediate member that is movable within housing 38 to effect actuation of primer bulb 42.

Between first end 34*a* and a second opposite end 34*b* (FIGS. 9 and 10), two stops 144 are fixed to cable 34. The throttle arm lost-motion connection comprises stops 144, a first slidable collar 148*a*, a second slidable collar 148*b*, and a spring 152 disposed between collars 148*a*,148*b*. Collars 148*a*,148*b* and spring 152 are supported on cable 34 between stops 144. Each of first and second collars 148*a*, 148*b* has a centrally located aperture through which cable 34 may slide. First collar 148*a* is fixed to throttle arm 140, thereby interconnecting cable 34 and control lever 26 to throttle arm 140 and the engine throttle.

The lost-motion connection between cable 24 and rod 160 comprises a second end 34*b* of cable 34 and an elongated chamber 156 that is connected to rod 160. Second end 34*b* has an enlarged ball 128 that is constrained to move linearly within elongated chamber 156. In an alternative embodiment, elongated chamber 156 is connected to cable 34 and rod 160 is provided with an enlarged end portion.

Rod 160 enters housing 38 and has a section (not shown) that is movable within housing 38 to effect actuation of primer bulb 42. For example, rod 160 may have a bent rod section such as bent rod section 46 in FIGS. 4 and 5. As described previously, bent rod section 46 is movable within housing 38 to engage movable block 50 such that movable block 50 moves linearly to depress primer bulb 42.

Alternatively, rod 160 may be adapted to include a cam such as cam 88 in FIGS. 6 and 7 (also described previously). In yet another embodiment, rod 160 may be directly attached to a movable member constrained within a housing and movable within the housing to depress primer bulb 42. Such a movable member 51 and housing 122 are shown in FIGS. 11 and 12 (also described previously).

Stops 144, collars 148, spring 152, cable 34, chamber 156, ball end 34*b*, and rod 160 all work as a coupling means between throttle arm 140 and rod 160 of FIGS. 4 and 5. Alternative means for coupling throttle arm 140 and rod 160 exist. These alternative means include but are not limited to substantially rigid linkages, cables, and other devices that interconnect and deliver motion from one mechanical device to another. Also, throttle arm 140 may be connected to the second end of cable 34 and the primer housing may be connected between the first end and the second end of cable 34.

Operation of remote control device 199 will now be described. In general, rotation of lever 26 directly effects linear movement of cable 34, and to a limited extent, rotation of throttle arm 140. Referring to the view of FIG. 9, when lever 26 is in the STOP position, chamber 156 is disposed adjacent housing 38 and ball end 34*b* is disposed at the right end of chamber 156 (as shown in dash lines in FIG. 9). Further, throttle arm 140 is at a rightmost position, and stops 144 and collars 148*a*,148*b* are disposed nearly adjacent the left end of chamber 156 (also shown in dash lines).

When lever 26 is rotated in the counter-clockwise direction to the RUN position, ball end 34*b* is moved to the left end of chamber 156, but chamber 156 remains disposed adjacent the housing 38. Cable 34 also moves collars 148*a*, 148*b*, spring 152, and stops 144 to the left. Further, cable 34 rotates throttle arm 140 in the clockwise direction, until throttle arm 140 rests against stop 164.

Referring to FIG. 10, when lever 26 is further rotated in the clockwise direction to the PRIME position, chamber 156 moves to the left with cable 34 since ball end 34*b* engages the left end of chamber 156. Accordingly, rod 160 extrudes from housing 38, thereby effecting actuation of the priming device within housing 38. In this way, cable 34, chamber 156, and rod 160 move together as one elongated assembly along a pre-defined curvilinear path. Although further movement of throttle arm 140 and first collar 148*a* is prevented by stop 164, cable 34 is able to slide through first collar 34*b*. In the process, spring 152 is compressed by second collar 148*b* against first collar 148*a*. When pressure on control lever 26 is released, decompression of spring 152 allows second end 34*b* of cable 34 to disengage from the left end of chamber 156. This allows a spring mechanism inside housing 38 to act on rod 160, thereby allowing primer bulb 42 to return to an unactuated state.

Although all of the embodiments depicted use bowden cable 34 as a means for effecting motion between an actuable member such as button 30 or lever 26, substantially rigid rods or other similar devices can be used in place of bowden cable 34.

Figure 2:
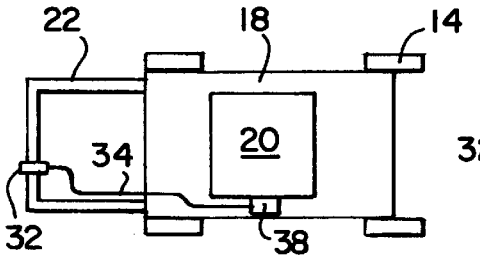
FIG. 2 is a top schematic view of a lawn mower depicting the primer housing attached to the side of the engine, as positioned in FIG. 1.
Figure 3:
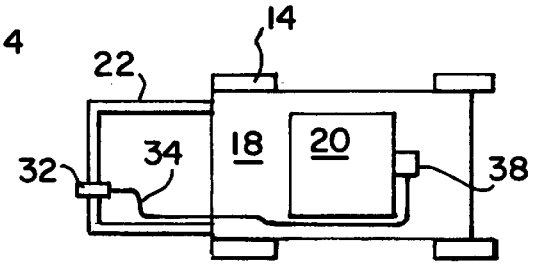
FIG. 3 is a top schematic view of a lawn mower depicting the housing alternately located on the front of the engine.

FIGS. 1 and 2 depict the first embodiment of the invention where housing 38 is located on the side of engine 20 and bowden cable 34 enters housing 38 substantially parallel to the side of engine 20 on which the base plane of the primer bulb lies. FIG. 2 depicts an alternative positioning for the invention where housing 38 is located on the front of engine 20 and bowden cable 34 enters housing 38 substantially parallel to the side of engine 20, on which the base plane of the primer bulb lies. Alternatively, as shown in FIGS. 11 and 12, configurations may be used in which bowden cable 34 enters housing 38 substantially perpendicular to the base plane of primer bulb 42.

While a preferred embodiment of the present invention has been illustrated and described, alternate embodiments will be apparent to those skilled in the art and are within the intended scope of the present invention. Therefore, the scope of the present invention is to be limited only by the following claims.

I claim:

1. A remote priming device for a working machine, the machine including an engine having a resilient primer bulb used in engine starts, and the working machine having a handle section disposed remotely from said engine, said handle section being used by a user to move the working machine, the remote priming device comprising:

a housing attachable adjacent to the primer bulb;

a linearly movable member, constrained to move within said housing such that the primer bulb is depressed in response to movement of said movable member; and an actuation device, positioned to move said movable member, including a remote subassembly, said actuation device having a first end positioned adjacent to said handle section and a second end adjacent to said housing.

2. The remote priming device of claim 1, wherein the resilient primer bulb has a vent hole, and wherein said movable member includes a bulb depressing surface that covers said vent hole when said movable member is moved.

3. The remote priming device of claim 1, wherein said movable member is substantially cylindrical, and wherein said movable member is constrained to slide in a substantially cylindrical sleeve within said housing.

4. The remote priming device of claim 1, wherein said movable member has a bulb depressing surface that is substantially flat.

5. The remote priming device of claim 1, further comprising at least one spring that enables said movable member to return to an unactuated state when said actuation device is not engaged.

6. The remote priming device of claim 5, wherein said spring is interconnected between said housing and said actuation device.

7. The remote priming device of claim 1, wherein said remote subassembly of said actuation device comprises:

a handle mountable support locatable remotely from said engine;

a manually actuable member interconnected with said handle mountable support; and a means for effecting motion of said movable member in response to actuation of said actuable member.

8. The remote priming device of claim 7, wherein said effecting means comprises a bowden cable.

9. The remote priming device of claim 7, wherein said remote subassembly includes:

a spring, disposed remotely from said housing, that enables said actuable member to return to an unactuated state when said actuable member is not engaged.

10. The remote priming device of claim 1, wherein said primer bulb has a base portion that lies in a basal plane, and wherein said movable member is constrained to move in a direction substantially normal to said basal plane.

11. The remote priming device of claim 1, wherein said actuation device includes a push button.

12. The remote priming device of claim 1, further comprising a flange adjacent to the primer bulb, and wherein said housing has a flange surface formed to interconnect with the flange.

13. The remote priming device of claim 1, wherein said actuation device includes a slidable bent rod substantially disposed within said housing and constrained to slide within said housing.

14. The remote priming device of claim 13, wherein said movable member has a rod engagement surface that is substantially rounded.

15. The remote priming device of claim 1, further comprising a rotating member including a cam, and wherein said cam is positioned to effect movement of said movable member, thereby causing said primer bulb to be depressed when said remote actuation device is actuated.

16. The remote priming device of claim 15, said device further comprising a pin, wherein said cam is mounted on said pin, said pin being substantially fixed to said housing, and wherein said rotating member is positioned to rotate about said pin.

17. The remote priming device of claim 15, further comprising a moment arm, wherein said moment arm is positioned to engage said cam and to cause rotation of said cam when said moment arm is actuated.

18. The remote priming device of claim 15, wherein said movable member has a cam surface positioned to engage said cam.

19. The remote priming device of claim 15, further comprising a spring that enables said cam to return to an unactuated state when said actuation device is not engaged.

20. The remote priming device of claim 19, wherein said spring is interconnected between said housing and said cam.

21. The remote priming device of claim 1, wherein said movable member is substantially cylindrical, wherein said movable member has a groove, and wherein said housing has at least one protrusion that rides in said groove.

22. The remote priming device of claim 21, wherein said movable member has an actuator surface positioned to engage said acutation device, and wherein said actuator surface is shaped to allow said movable member to rotate.

23. The remote priming device of claim 1, wherein the engine includes a throttle, said remote priming device further comprising:

a throttle arm interconnected with the throttle such that the position of the throttle is changed in response to movement of the throttle arm, wherein said actuation device is interconnected with said throttle arm and engageable with said movable member, such that said actuation device is actuable to effect motion of at least one of said throttle arm and said movable member.

24. The remote priming device of claim 23, wherein said actuation device includes a lost motion connection that allows movement of said throttle arm in response to movement of said actuation device without effecting motion of said movable member.

25. The remote priming device of claim 23, wherein said actuation device is interconnected with said throttle arm such that said movable member may be moved to depress said primer bulb without effecting motion of said throttle arm.

26. The remote priming device of claim 23, wherein said actuation device further comprising:

a manually actuable member locatable adjacent the handle section; and an enlongated member interconnected with said actuable member and movable by said actuable member to effect motion of at least one of said movable member and said throttle arm.

27. The remote priming device of claim 26, wherein said actuation device further includes an intermediate member interconnected with said elongated member and engageable with said movable member, said intermediate member and said elongated member being movable along a substantially curvilinear path to effect motion of said movable member.

28. The remote priming device of claim 26, wherein said actuation device further includes:

an intermediate member interconnected with said elongated member and engageable with said movable member; and a lost motion connection disposed between said elongated member and said intermediate member such that said elongated member may be moved relative to said intermediate member without effecting motion of said movable member.

29. The remote priming device of claim 28, wherein said lost motion connection includes a chamber formed with one of said elongated member and said intermediate member, and an end portion formed with the other of said elongated member and said intermediate member, said end portion being constrained to move within said chamber.

30. The remote priming device of claim 26, wherein said throttle arm is interconnected with said elongated member such that said elongated member may be moved to effect motion of said movable member without effecting motion of said throttle arm.

31. The remote priming device of claim 26, wherein said actuation device further includes a lost motion connection disposed between said elongated member and said movable member such that said elongated member may be moved to effect motion of said throttle arm without effecting motion of said movable member.

32. The remote priming device of claim 26, wherein said actuation device further includes a compressible body disposed between said throttle arm and said elongated member, said compressible body being adapted to permit movement by said elongated member in a direction of compression to effect motion of said movable member without effecting motion of said throttle arm.

* * * * *